US007405644B2

(12) United States Patent
Herzog

(10) Patent No.: US 7,405,644 B2
(45) Date of Patent: Jul. 29, 2008

(54) CORE ASSEMBLY, IN PARTICULAR FOR AN IGNITION COIL OF AN INTERNAL COMBUSTION ENGINE

(75) Inventor: Florian Herzog, Waltenhofen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/508,799

(22) Filed: Aug. 22, 2006

(65) Prior Publication Data

US 2007/0046416 A1 Mar. 1, 2007

(30) Foreign Application Priority Data

Aug. 23, 2005 (DE) ..... 10 2005 039 761

(51) Int. Cl.
*H01F 27/24* (2006.01)

(52) U.S. Cl. ..... 336/234

(58) Field of Classification Search ..... 336/65, 336/90–96, 192, 198, 233–234; 123/634–635
See application file for complete search history.

(56) References Cited

U.S. PATENT DOCUMENTS

| | | | | |
|---|---|---|---|---|
| 5,767,758 | A * | 6/1998 | Sakamaki | 336/84 M |
| 5,870,012 | A * | 2/1999 | Sakamaki et al. | 336/107 |
| 6,208,231 | B1 * | 3/2001 | Oosuka et al. | 336/107 |

FOREIGN PATENT DOCUMENTS

| | | |
|---|---|---|
| DE | 195 10 489 | 10/1996 |
| DE | 101 40 854 | 3/2003 |
| DE | 10 2004 008986 | 9/2005 |

* cited by examiner

*Primary Examiner*—Tuyen T. Nguyen
(74) *Attorney, Agent, or Firm*—Kenyon & Kenyon LLP

(57) ABSTRACT

An ignition coil for an internal combustion engine includes a core assembly. The core assembly has a magnetically active core made of sheet-metal strips, a damping element and a sheath surrounding the core and the damping element. Different ways are described for improving the discharge of air trapped in the core assembly during casting of the ignition coil. For example, the damping element is designed with a V-shaped incision or a semipermeable diaphragm.

3 Claims, 2 Drawing Sheets

CORE ASSEMBLY, IN PARTICULAR FOR AN IGNITION COIL OF AN INTERNAL COMBUSTION ENGINE

BACKGROUND INFORMATION

A core assembly is described in non-prepublished German Patent Application No. DE 10 2004 008986.

When a core assembly is mounted in an ignition coil, the core assembly is positioned in the ignition coil housing during premounting. The premounted ignition coil is then cast in a casting chamber according to a vacuum casting process, using a casting resin made of epoxy resin. Casting takes place in a vacuum to be able to fill all cavities of the ignition coil with the epoxy resin or casting resin and impregnate the windings. Because the core stack is surrounded by a sheath, usually in the form of a heat-shrinkable sleeve, as well as a damping element and a cover on the side of the core assembly diametrically opposed to the damping element, a pressure gradient is produced between the interior of the core assembly and its surroundings upon evacuation of the casting chamber. However, the pressure gradient decreases only very slowly, so that air exits the core assembly even during the ignition coil casting process carried out in a vacuum, which may cause bubbles to form in the cured casting resin or even at its surface. The formation of bubbles may impair the function of the bar-type ignition coil over the course of its life. As a result, an attempt is made to remove the air present in the coil as early as a prevacuum step, which takes place prior to casting. German Patent Application No. DE 10 2004 008986 also describes an air passage in the form of at least one slot provided in the damping element to improve the discharge of air from the core area.

An object of the present invention is to improve the known core assembly through alternative air evacuation means to further minimize or completely prevent the entrapment of air bubbles during casting of the core assembly.

SUMMARY OF THE INVENTION

The core assembly according to the present invention, in particular for an ignition coil of an internal combustion engine, has the advantage that particularly good evacuation of the core stack is achieved so that air present in the core stack may be discharged in the form of air bubbles particularly easily and effectively as early as during the prevacuum stage. This reliably avoids air entrapment during casting, so that the electrical properties, in particular the insulation properties, of the core assembly and thus also of the ignition coil are improved, since this prevents voltage sparkover in the ignition coil as a result of cavities.

DETAILED DESCRIPTION

Figure 1:
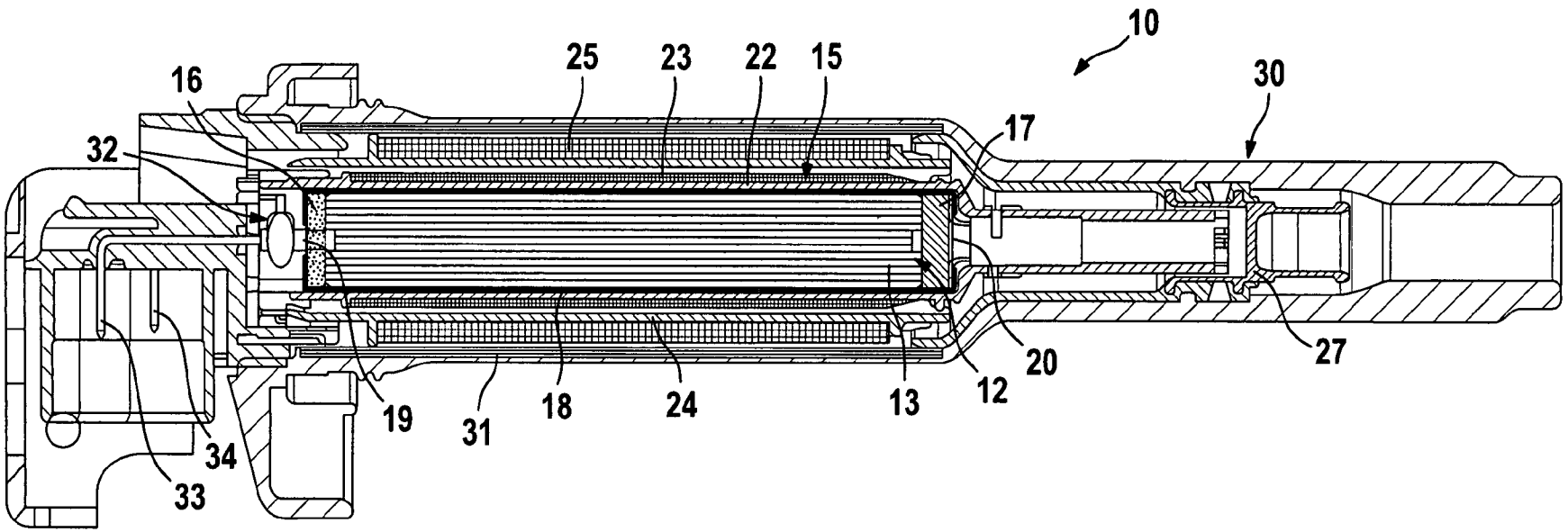
FIG. 1 shows a longitudinal cross section of an ignition coil having a first core assembly according to the present invention.

Ignition coil 10 illustrated in FIG. 1 is designed as a bar-type ignition coil and is used to directly contact a spark plug (not illustrated) of an internal combustion engine in a motor vehicle. Ignition coil 10 has a magnetically active core 12 which includes a plurality of rectangular sheet-metal strips 13 made of a ferromagnetic material and having varying widths to achieve a largely circular cross sectional area. Core 12 is an integral part of a core assembly 15, which also has at least one damping element 16 situated at one end of core 12 as well as a permanent magnet 17 or a core cover plate situated at the other end of core 12.

Along with damping element 16 and permanent magnet 17, core 12 is enclosed by a heat-shrinkable sleeve 18 which improves the thermomechanical properties of core assembly 15 and has a hole 19, 20 at each end of core assembly 15 resulting from the shrinkage of heat-shrinkable sleeve 18. Heat-shrinkable sleeve 18 also helps achieve a defined positioning of damping element 16 and permanent magnet 17 or the core cover plate, respectively, so that no additional connecting means are necessary.

A secondary coil 22 having a secondary winding 23 and a primary coil 24 having a primary winding 25 are situated concentrically around core assembly 15. Secondary winding 23, which carries high voltage, is coupled with a sleeve-shaped contacting element 27 used to accommodate the spark plug head. Contacting element 27 and primary coil 24 are situated within an ignition coil housing 30 which determines the outer shape of ignition coil 10. A longitudinally slotted, sleeve-shaped return plate 31 is also situated within ignition coil housing 30. An electric circuit 32 coupled with primary winding 25 is situated within ignition coil housing 30 on the side of primary coil 24 diametrically opposed to contacting element 27. Electric circuit 32 is connected to the electric system of the motor vehicle via connecting plugs 33, 34. An ignition coil 10 described to this extent as well as the operation thereof are generally known and are therefore not explained in greater detail here.

When assembling ignition coil 10, the aforementioned components of ignition coil 10 are inserted into ignition coil housing 30, and ignition coil housing 30 is subsequently filled from the side of connecting plugs 33, 34 with an initially liquid epoxy resin serving as the casting compound, which fills the spaces between the individual components of ignition coil 10 and thus provides insulation between the voltage-carrying components. To support the casting process and promote the discharge of air trapped in ignition coil housing 30, casting is carried out in a vacuum.

Figure 2:
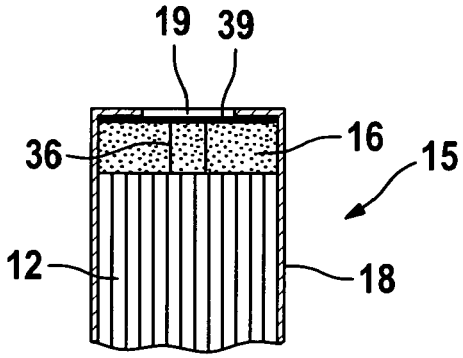
FIG. 2 shows a side view of a detail of the core assembly.
Figure 3:
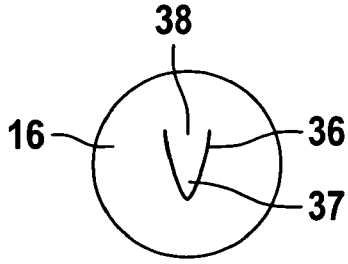
FIG. 3 shows a top view of a damping element from FIG. 2.

Since core assembly 15 includes sheet-metal strips 13 of varying widths and is enclosed by a heat-shrinkable sleeve 18, a number of cavities are present in core assembly 15 or core 12. To enable or improve the discharge of air from these cavities and core assembly 15, damping element 16 must be provided, according to the present invention, with a V-shaped incision 36, as shown in FIGS. 2 and 3. This incision 36 forms a flap 37 which is connected in an articulated manner to damping element 16 in an incision-free zone 38. To enable or accelerate the discharge of gas from core assembly 15, the top of ignition coil 10, i.e., from the side of connecting plugs 33, 34, is placed in a vacuum or under low pressure. This causes flap 37 to lift away from core 12 and thereby form a passage for the air bubbles trapped in core assembly 15 or core 12.

Damping element 16, which is made of foamed silicone, is advantageously formed during the manufacturing process in such a way that a (silicone) skin forming during manufacture is separated or cut off on the side facing core 12 so that damping element 16 has an open-pore structure on the side facing core 12. This enables air bubbles rising from core 12 in the direction of damping element 16 to enter the area of damping element 16 over the entire circular cross sectional area of core 12 and, from there, to reach incision 36 from the side. Furthermore, silicone skin 39 present on the top of damping element 16, due to the cooling of the silicone during the manufacture of damping element 16, prevents epoxy resin from entering damping element 16 on the side diametrically opposed to core 12 and thereby impairs the operation of flap 37.

Figure 4:
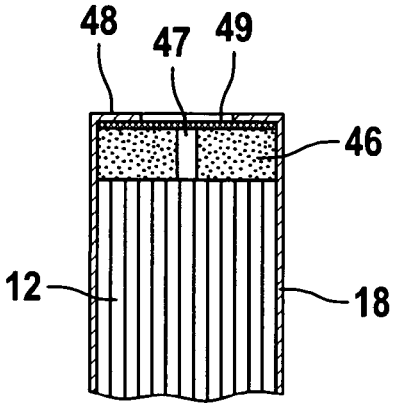
FIG. 4 shows a longitudinal cross section of a second core assembly which has been modified with regard to FIG. 2, having a semipermeable diaphragm.

In the modified embodiment illustrated in FIG. 4, damping element 46 has a through hole 47 in its center. Through hole 47 is situated in an area which passes within a flange-like circumferential edge area 48 or in the area of hole 19 in heat-shrinkable sleeve 18. A semipermeable diaphragm 49 is positioned on damping element 46 on the side diametrically opposed to core 12. Diaphragm 49 permits the passage of gas or air from the direction of core 12. In this case, the silicone skin should also be separated ahead of time on the side of damping element 46 facing diaphragm 49 to enable the gas to pass easily.

Alternatively, it is also conceivable, for example, to produce the sheath of core assembly 15 designed as heat-shrinkable sleeve 18 from a (semi) gas-permeable material instead of diaphragm 49. In this case, it would not be necessary to remove the (silicone) skin layer on damping element 46 or even to provide a through hole in damping element 46.

Figure 5:
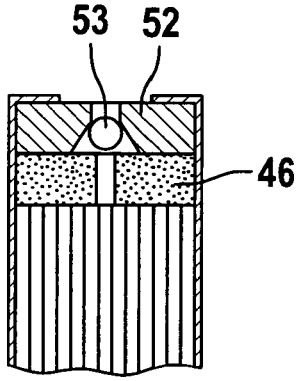
FIG. 5 shows a longitudinal cross section of a modified third core assembly having a movable valve closing member.

The embodiment according to FIG. 5 differs from the embodiment according to FIG. 4 in that a valve 52 having a valve member 53 is used instead of diaphragm 49. In the illustrated embodiment, valve member 53 is designed as a sphere so that valve 52 acts as a kind of nonreturn or pressure relief valve.

Figure 6:
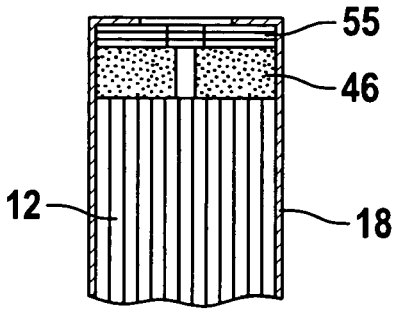
FIG. 6 shows a longitudinal cross section of a modified fourth core assembly having a valve device made of plastic.

In the embodiment illustrated in FIG. 6, a valve device 55 of a known type used, for example, as a pressure relief valve for packaging containers, is provided on damping element 46. For this purpose, a valve device 55 of this type may include either different flexible layers arranged in a stack or a rigid base member on which a flexible valve diaphragm is situated. For details on the precise structure and operation of valve devices 55 of this type, reference is hereby made by way of example to German Patent Application Nos. DE 195 10 489 and DE 101 40 854.

The discharge of air from core assembly 15 is facilitated in all exemplary embodiments described, since a defined passage is provided for the air.

What is claimed is:

1. A core assembly comprising:

a plurality of strip-shaped metal sheets made of a ferromagnetic material, which form a rod-shaped core having a circular cross section;

a damping element situated at at least one end of the core;

a sheath surrounding the core and the damping element; and an evacuation device for discharging air present in intermediate spaces of the core from the core assembly, the evacuation device having a V-shaped slot situated in the damping element.

2. The core assembly according to claim 1, wherein the core assembly is for an ignition coil of an internal combustion engine.

3. The core assembly according to claim 1, wherein the damping element is made of a foamed silicone material, a silicone skin layer formed during manufacture of the damping element being removed on a side of the damping element facing the core so that an open-pore passage area for gas is provided, a skin layer on the damping element remaining unchanged on a side facing away from the core.

* * * * *